US005945957A

United States Patent [19]

Kakizawa

[11] Patent Number: 5,945,957

[45] Date of Patent: Aug. 31, 1999

[54] WINDOW GLASS ANTENNA APPARATUS

[75] Inventor: Hitoshi Kakizawa, Osaka, Japan

[73] Assignees: Nippon Sheet Glass Co., Ltd.; Toko, Inc., both of Japan

[21] Appl. No.: 09/008,160

[22] Filed: Jan. 16, 1998

[30] Foreign Application Priority Data

Jan. 16, 1997 [JP] Japan ..... 9-005856

[51] Int. Cl.[6] ..... H01Q 1/32

[52] U.S. Cl. ..... 343/713; 343/704; 333/119

[58] Field of Search ..... 343/713, 850, 343/856, 860, 862; 333/112, 118, 119, 126, 129, 132, 131; H01Q 1/32

[56] References Cited

U.S. PATENT DOCUMENTS

| | | | |
|---|---|---|---|
| 4,814,730 | 3/1989 | Via et al. | 333/119 |
| 5,072,230 | 12/1991 | Taniyoshi et al. | 343/715 |
| 5,258,728 | 11/1993 | Taniyoshi et al. | 333/132 |
| 5,345,604 | 9/1994 | Wiedemann | 455/139 |
| 5,602,558 | 2/1997 | Urakami et al. | 343/850 |
| 5,781,160 | 7/1998 | Walton | 343/713 |
| 5,821,904 | 10/1998 | KaKizawa et al. | 343/704 |
| 5,877,727 | 3/1999 | Saitou et al. | 343/713 |

FOREIGN PATENT DOCUMENTS 4-45312 10/1992 Japan .

*Primary Examiner*—Hoanganh Le
*Assistant Examiner*—Shih-Chao Chen
*Attorney, Agent, or Firm*—Adams & Wilks

[57] ABSTRACT

A window glass antenna apparatus comprises two antennas exclusively for receiving respective AM and FM radio signals, a first impedance transformer disposed between the antennas and a signal cable for transforming impedance in an AM frequency band from high impedance to low impedance, and a second impedance transformer provided at an output side of the signal cable for transforming impedance in the AM frequency band from low impedance to high impedance. The first impedance transformer includes a primary winding which has one end connected to the AM radio signal receiving antenna, and a tap provided at a primary side thereof and connected to FM radio signal receiving antenna. The second impedance transformer includes a secondary winding which has one end for serving as an AM radio signal output terminal, and a tap provided at a secondary side thereof for serving as an FM radio signal output terminal.

5 Claims, 7 Drawing Sheets

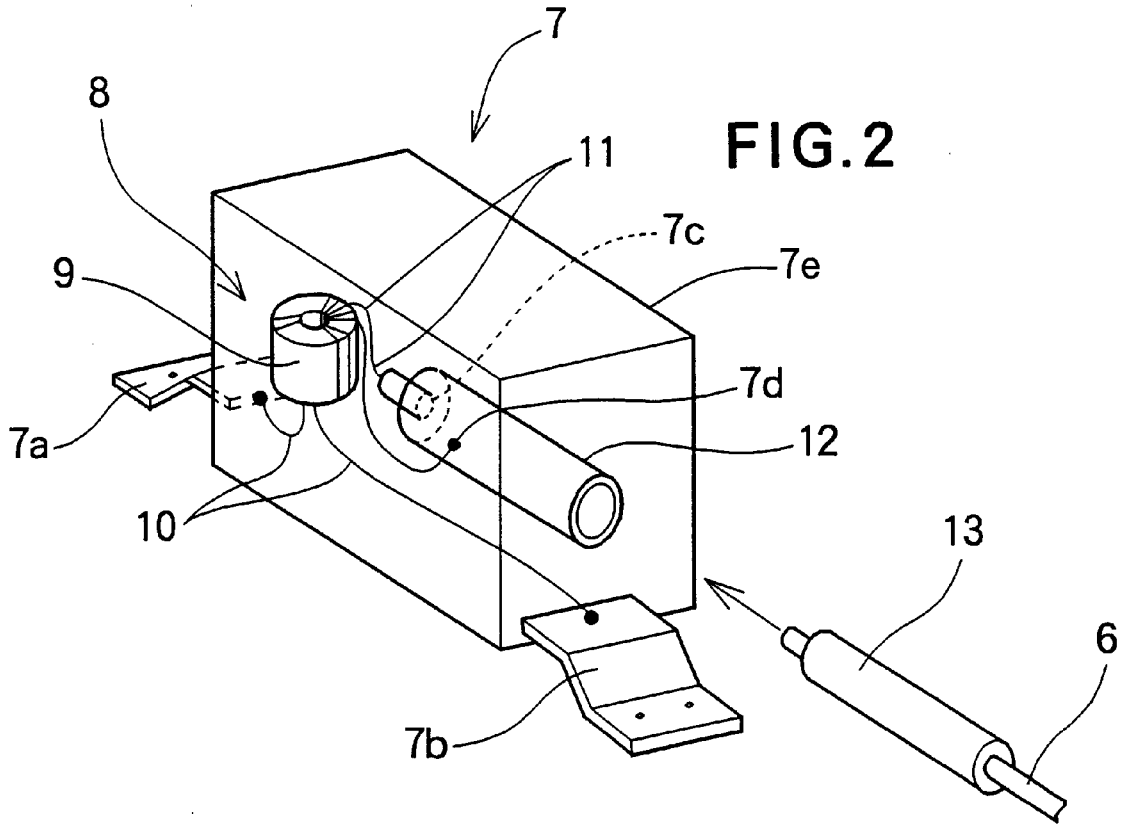
FIG. 2
FIG. 3
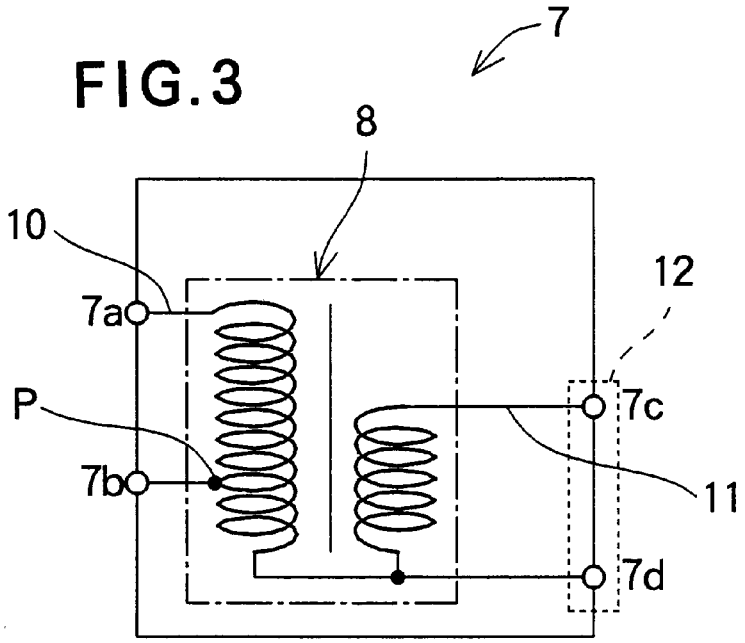

WINDOW GLASS ANTENNA APPARATUS

BACKGROUND OF THE INVENTION

1. Field of the Invention

The present invention relates to a window glass antenna apparatus to be disposed on a window glass of an automobile for receiving radio broadcasts.

2. Description of the Related Art

In Japanese Utility Model Publication No. HEI 4-45312, there is disclosed a window glass antenna apparatus which comprises an antenna for receiving AM/FM radio signals, a signal cable, a first impedance transforming circuit connected between the signal cable and antenna for transforming the impedance in a frequency band of AM radio signal (AM frequency band) from high impedance to low impedance, a first filter circuit connected between the signal cable and antenna for allowing passage of FM radio signals, a second impedance transforming circuit connected between the signal cable and an antenna input circuit of a radio receiver for transforming the impedance in the AM frequency band from low impedance to high impedance, and a second filter circuit connected between the signal cable and antenna input circuit for allowing passage of the FM radio signals.

Each of the first and second filter circuits includes an LC series resonance circuit. An equivalent circuit for the AM frequency band is illustrated in FIG. 8 hereof for explaining the principle wherein the capacitance of filter is taken into consideration.

In the figure, Co collectively represents antenna effective capacitance existing between the antenna and ground, and antenna reactive capacitance existing at the antenna output in series therewith. An AM radio signal received by the antenna is represented as an AC power source Vi. Cb represents cable capacitance of the signal cable 6. Reference numerals 22 and 25 are transformers forming the first and second impedance conversion circuits.

However, the window glass antenna apparatus disclosed in Japanese Utility Model Publication No. HEI 4-45312 has a drawback in that due to capacitance component Cf of the LC series resonance circuits forming the first and second filter circuits, the antenna impedance decreases, thereby decreasing sensitivity for the reception of AM radio signals.

SUMMARY OF THE INVENTION

According to a first aspect of the present invention, there is provided a window glass antenna apparatus having an AM radio signal receiving antenna and an FM radio signal receiving antenna, both disposed on a window glass of an automobile, and a signal cable for transmitting received signals from the antennas, the window glass antenna apparatus comprising: a first impedance transformer including a primary winding and a secondary winding for transforming impedance in a frequency band of AM radio signal from high impedance to low impedance, the primary winding having a terminal provided at one end thereof and connected to the AM radio signal receiving antenna, and a tap provided at a primary side thereof and connected to the FM radio signal receiving antenna, the secondary winding having a terminal provided at one end thereof and connected to an input side of an inner conductor of the signal cable; a second impedance transformer including a primary winding and a secondary winding for transforming impedance in the AM radio signal frequency band from low impedance to high impedance, the primary winding having a terminal provided at one end thereof and connected to an output side of the inner conductor of the signal cable; and the secondary winding of the second impedance transformer having one end for serving as an AM radio signal output terminal, the second impedance transformer having a tap provided at a secondary side thereof for serving as an FM radio signal output terminal.

By thus providing AM radio signal receiving antenna and the FM radio signal receiving antenna separately on the automobile window glass, it becomes possible to employ antenna patterns suitable for receiving AM and FM radio signals, thereby improving the sensitivity for the reception of the AM/FM radio signals.

Since the one end of the secondary winding of the second impedance transformer is used as the AM radio signal output terminal, it becomes possible to reduce transmission loss in the AM frequency band resulting from the cable capacitance. Also, since the secondary side tap of the second impedance transformer is used as the FM radio signal output terminal, it becomes possible to effect the impedance transformation in the frequency band of FM radio signal (FM frequency band), thus contributing to the desired impedance matching.

Further, since the inventive arrangement does not require the LC series resonance circuit serving as the first and second filter circuits as used in the conventional arrangement, it becomes possible to prevent the sensitivity for the reception of AM radio signals from dropping due to capacitance components of the LC series resonance circuit, and to make the window glass antenna apparatus simple in construction.

According to a second aspect of the present invention, there is provided a window glass antenna apparatus having an AM radio signal receiving antenna and an FM radio signal receiving antenna, both disposed on a window glass of an automobile, and a signal cable for transmitting received signals from the antennas, said window glass antenna apparatus comprising: a first impedance transformer including a primary winding and a secondary winding for transforming impedance in a frequency band of AM radio signal from high impedance to low impedance, the primary winding having a terminal provided at one end thereof and connected to the AM radio signal receiving antenna, and a tap provided at a primary side thereof and connected to the FM radio signal receiving antenna, the secondary winding having a terminal provided at one end thereof and connected to an input side of an inner conductor of the signal cable; a second impedance transformer including a primary winding and a secondary winding for transforming impedance in the AM radio signal frequency band from low impedance to high impedance, the primary winding having a terminal provided at one end thereof and connected to an output side of the signal cable inner conductor; and a capacitor having one end connected to the output side of the inner conductor and an opposite end for serving as an FM radio signal output terminal, the secondary winding of the second impedance transformer having one end for serving as an AM radio signal output terminal.

By thus using the opposite end of the capacitor as the FM radio signal output terminal, it becomes possible to effect the impedance transformation in the FM frequency band, thereby contributing to the desired impedance matching. Also, provision of the capacitor at the FM radio signal output terminal makes it possible to attenuate the AM radio signals having frequencies lower than those of the FM radio signals.

The first impedance transformer may be comprised of spiral wirings printed on a flexible printed-circuit board. As a result, it becomes possible to make the first impedance transformer thin, light and small compared to the one in which ferrite magnets are used.

BRIEF DESCRIPTION OF THE DRAWINGS

Preferred embodiments of the present invention will be described in detail hereinbelow, by way of example only, with reference to the accompanying drawings, in which:

FIG. 2 is a schematic perspective view illustrating the general arrangement of an impedance transformer of the window glass antenna apparatus;

FIG. 3 is a circuit diagram of the impedance transformer;

DETAILED DESCRIPTION OF THE PREFERRED EMBODIMENTS

The following description is merely exemplary in nature and is in no way intended to limit the invention or its application or uses.

Figure 1:
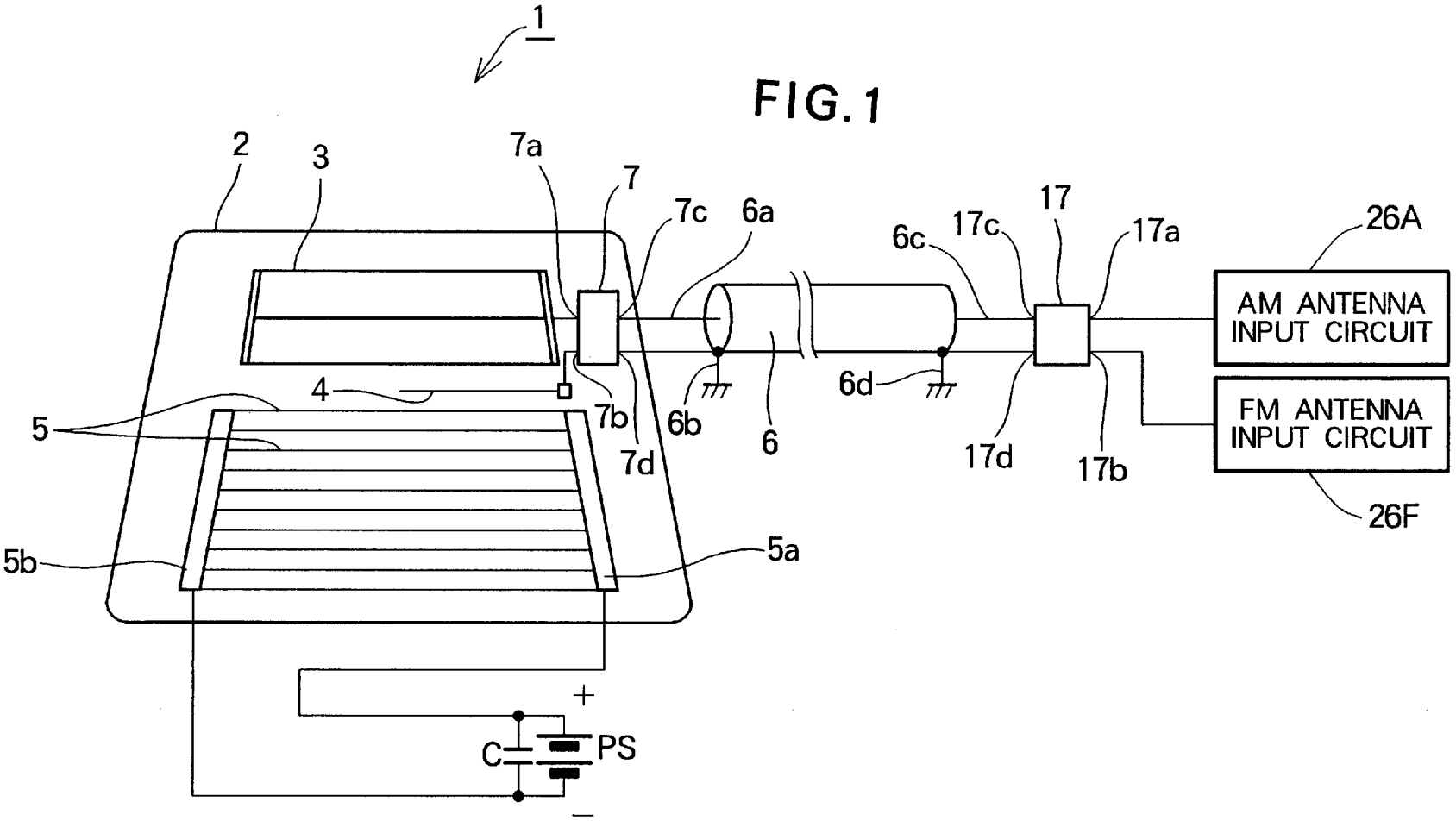
FIG. 1 is a schematic view illustrating the general arrangement of a window glass antenna apparatus according to a preferred embodiment of the present invention.

Referring initially to FIG. 1, a window glass antenna apparatus 1 according to a preferred embodiment of the present invention comprises an AM radio signal receiving antenna 3 and an FM radio signal receiving antenna 4, which are both disposed on a pane of window glass 2 of an automobile. The antenna apparatus 1 also includes a signal cable 6 composed of a coaxial cable for transmitting signals received by the antennas 3 and 4.

The AM signal receiving antenna 3 and the FM signal receiving antenna 4 are provided separately on the window glass 2 in conductive patterns. Separate provision of the AM/FM radio signal receiving antennas 3, 4 allows formation of antenna patterns most suited for the reception of respective AM/FM radio signals, thereby improving the reception sensitivity of AM/FM radio signals.

The conductive patterns of the AM radio signal receiving antenna 3 and the FM radio signal receiving antenna 4 are formed by preparing a conductive paste resulted from mixing, e.g., fine silver particles and a glass powder of low melting point in an organic solvent, screen printing the conductive paste to provide conductive lines on the window glass 2 and then sintering the conductive lines. The conductive patterns may also be formed by other conductive metal lines or conductive elements such as conductive metal foils. As the conductive line patterns, transparent planar conductive patterns, for example, may be used.

Defogging heater lines 5 are formed by screen printing, for example, a fine Nichrome line or a conductive paste of silver on the window glass 2 and then sintering it. The power for heating the heater lines 5 is supplied from, for example, a DC power source PS of an automobile battery through bus bars 5*a*, 5*b*. Between the two poles of the power source PS, a capacitor C is provided for absorbing noises.

A first impedance transformer 7 is disposed between the antennas 3, 4 and the signal cable 6 and comprises a transformer capable of impedance transformation. The first impedance transformer 7 transforms impedance in an AM frequency band from high impedance to low impedance. A terminal 7*a* of a primary winding of the transformer 7 is connected to the AM radio signal receiving antenna 3. A primary side tap 7*b* of the transformer 7 is connected to the FM radio signal receiving antenna 4. One terminal 7*c* of a secondary winding of the transformer 7 is connected to a central or inner conductor 6*a* of the signal cable 6 while another terminal 7*d* is connected to an external conductor 6*b* of the signal cable 6. The external conductor 6*b* is connected to a body of the automobile.

A second impedance transformer 17 is disposed between the signal cable 6 and an AM antenna input circuit 26A and an FM antenna input circuit 26F. The second impedance transformer 17 transforms impedance in the AM frequency band from low impedance to high impedance. One terminal 17*c* of a primary winding of the transformer 17 is connected to a central or inner conductor 6*c* of the signal cable 6 while another terminal 17*d* is connected to an external conductor 6*d* of the signal cable 6. The external conductor 6*d* is connected to the automobile body. A terminal 17*a* of a secondary winding of the transformer 17 is an AM radio signal output terminal and is connected to an AM antenna input circuit 26A. A secondary side tap 17*b* of the transformer 17 is an FM radio signal output terminal and is connected to an FM antenna input circuit 26F.

The larger the capacitance of the AM radio signal receiving antenna 3 becomes relative to the capacitance of the signal cable 6, the higher the gain of the antenna 3 becomes, thereby improving the sensitivity for the reception of AM radio signals.

Reception signals from the AM radio signal receiving antenna 3 are fed to the terminal 7*a* of the impedance transformer 7. The sensitivity for the reception of AM radio signals is improved by means of the first impedance transformer 7 which effects the impedance transformation between the AM radio signal receiving antenna 3 and the signal cable 6. By thus providing the first impedance transformer 7, it becomes possible to reduce the capacitance of the signal cable 6 as viewed from the AM radio signal receiving antenna 3, thereby reducing the transmission loss of signals. Stated otherwise, provision of the first impedance transformer 7 enlarges the capacitance of the AM radio signal receiving antenna 3 as viewed from the signal cable 6.

Reception signals from the FM radio signal receiving antenna 4 are supplied to the primary side tap 7*b* of the first impedance transformer 7 which effects the impedance transformation between the FM radio signal receiving antenna 4 and the signal cable 6.

The reception signals from the AM radio signal receiving antenna 3 and the FM radio signal receiving antenna 4 are supplied from the first impedance transformer 7 as a composite reception signal in an AM/FM frequency band to the second impedance transformer 17 via coaxial connector 12 (see FIG. 2) and a feeder cable 6. The second impedance transformer 17 supplies the reception signal through the secondary side terminal 17*a* and the secondary side tap 17*b* to the AM antenna input circuit 26A and the FM antenna input circuit 26F of an external radio receiver.

FIG. 2 schematically illustrates the construction of the first impedance transformer. In describing FIG. 2, reference is also had to FIG. 1.

As shown in FIG. 2, the first impedance transformer 7 comprises a transformer 8 with a core 9 on which a primary side wire 10 and a secondary side wire 11 are wound, the coaxial connector 12 connected to both ends of the secondary side wire 11, the conductive terminal 7*a*, and the primary side tap 7*b*.

In the first impedance transformer 7, the terminal 7*a* is connected with the primary winding 10 while the secondary winding 11 and the coaxial connector 12 are interconnected at their terminals. The primary winding 10, secondary winding 11 and the coaxial connector 12 are enclosed together with the core 9 within a casing 7*e* which is made of an insulative synthetic resin.

The core 9 forming the transformer 8 is formed of, for example, a toroid core. The winding 10 and 11 may be formed of an enameled wire or a formal wire. The winding 10 is wound a predetermined number of turns on the primary side of the core 9 while the winding 11 is wound a predetermined number of turns on the secondary side.

The number of turns of the windings 10, 11 may be set depending on conditions such as the impedance of the AM radio signal receiving antenna 3 connected to the primary side terminal 7*a* and the signal cable 6 connected between the secondary side terminals 7*c*, 7*d*, and the frequency band of the reception signal.

For example, the signal cable 6 may be set to have the impedance of 50Ω and the cable capacitance of 120 pF. For receiving radio broadcasts in the AM/FM frequency band, the winding or turn ratio of the primary side to the secondary side of the transformer 8 may be set so that the impedance of the AM radio signal receiving antenna 3 and the impedance of the signal cable 6 are matched to thereby provide the optimum sensitivity.

An experiment revealed that the turn ratio of the primary side to the secondary side of the transformer 8 in the range of 20:1–4:1 produces the sensitivity which poses no problems in practical uses, and 9:1 is most desirable. The inductance of the transformer 8 may be in the range of 20 mH–1 mH, and desirably 5 mH.

For reducing the transmission loss of the reception signal in the transformer 8 itself, thicker wires may be used for the primary and secondary windings 10, 11 or otherwise the transformer 8 may be formed on the core 9 of higher permeability with fewer turns.

The terminal 7*a* is solder connected to the AM radio signal receiving antenna 3 while the primary side tap 7*b* is solder connected to the FM radio signal receiving antenna 4. The received signal from the AM radio signal receiving antenna 3 is supplied via the terminal 7*a* to the primary winding 10 of the transformer 8. The received signal from the FM radio signal receiving antenna 4 is supplied via the primary side tap 7*b* to the primary winding 10 of the transformer 8. Both received signals are fed as a composite reception signal to the secondary winding 11 which is electromagnetically-coupled to the primary winding.

The composite reception signal is fed from the terminals 7*c*, 7*d* of the female coaxial connector 12 connected to the secondary winding 12, to the signal cable 6 via the male coaxial connector 13 connected to the female coaxial connector 12.

In place of the coaxial connector 12, a terminal plate may be provided to project outwardly from the casing 7*e* so that the inner conductor and the external conductor of the signal cable 6 can be connected directly to the projection of the terminal plate.

As explained above, the first impedance transformer 7 includes the transformer 8 which transforms the impedance between the antennas 3, 4 and the signal cable 6 to thereby improve the reception sensitivity.

Reference is now had to FIG. 3 illustrating the electrical circuit of the first impedance transformer.

As shown in FIG. 3, the first impedance transformer 7 includes the core 9 (see FIG. 2) on which the primary and secondary windings 10, 11 are wound a predetermined number of turns so that the winding ratio of the primary side (terminal 7*a*–terminal 7*d*) to the secondary side (terminal 7*c*–terminal 7*d*) becomes 9:1 as mentioned above.

The point of connection P of the primary side tap 7*b* is provided at a portion of the primary winding 10 so that the winding ratio of the connection point P—the terminal 7*d* to the terminal 7*c*—terminal 7*d* falls within a range of 4:1–0.5:1, preferably becomes 1:1.

Figure 4:
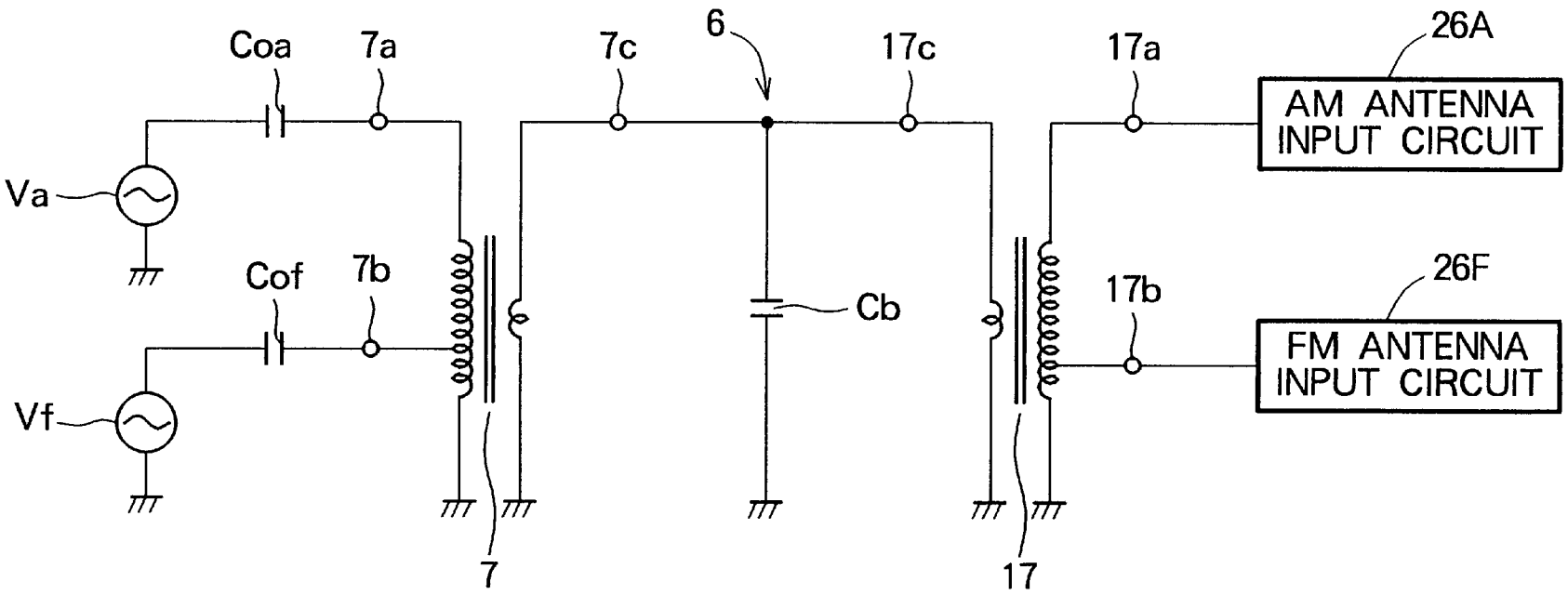
FIG. 4 is a circuit diagram of an equivalent circuit for AM frequency band for explaining the principle of the window glass antenna apparatus.

Reference is made next to FIG. 4 illustrating an AM frequency band equivalent circuit for explaining the principle of the window glass antenna apparatus of FIG. 1.

Figure 8:
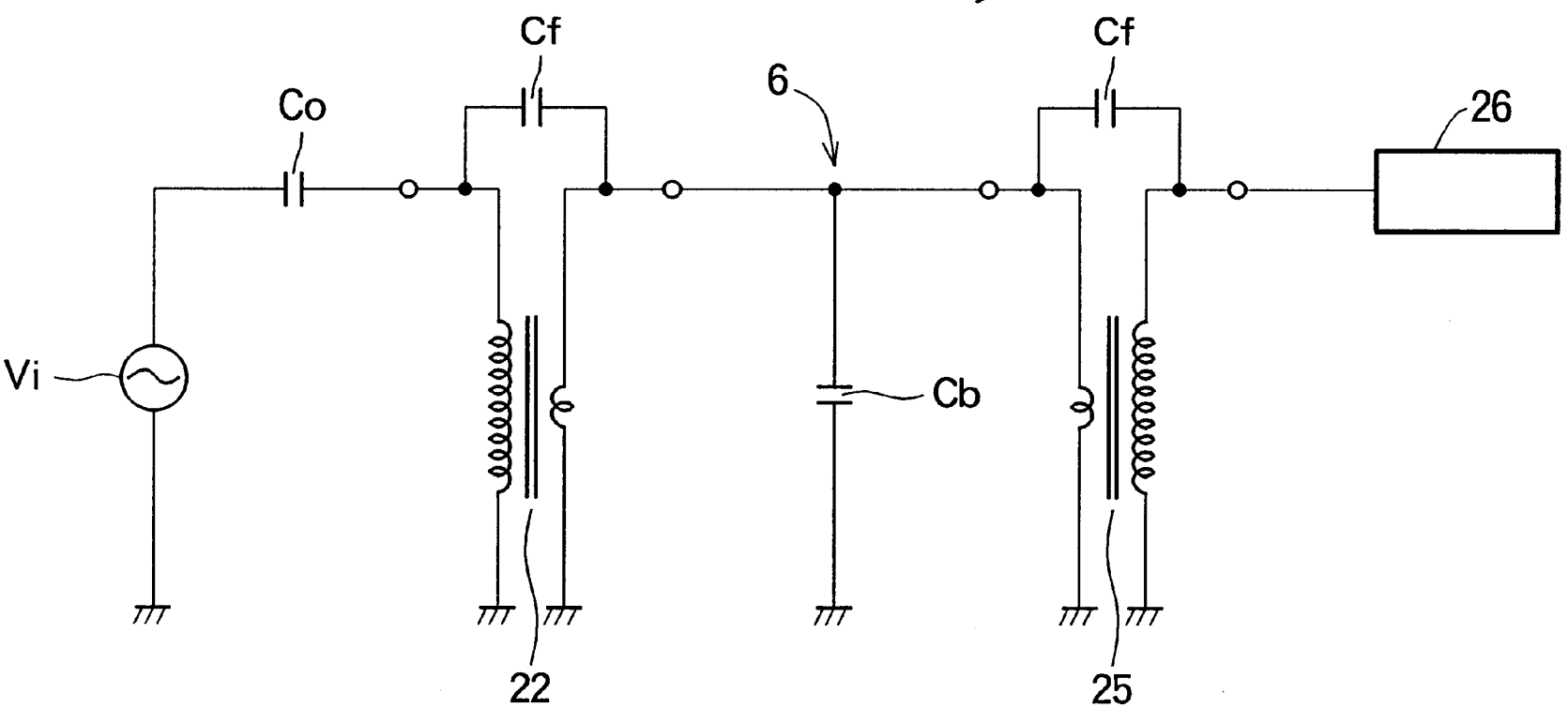
FIG. 8 (PRIOR ART)
FIG. 8 is a circuit diagram of an equivalent circuit of AM frequency band for explaining the principle of a conventional window glass antenna apparatus.

In FIG. 4, reference character Coa represents combined capacitance of antenna effective capacitance arising between the AM radio signal receiving antenna 3 and the ground level, and antenna reactive capacitance connected in series therewith. Reference character Cof represents combined capacitance of antenna effective capacitance arising between the FM radio signal receiving antenna 4 and the ground level, and antenna reactive capacitance connected in series therewith. An AM radio signal received by the AM radio signal receiving antenna 3 is represented by an AC power source Va. An FM radio signal received by the FM radio signal receiving antenna 4 is represented by an AC power source Vf. As is now apparent, the equivalent circuit according to the present invention has no capacitance components Cf as found in the prior arrangement of FIG. 8. As a result, it is possible in the inventive equivalent circuit to prevent the impedance of the AM radio signal receiving antenna from becoming low and hence to avoid the deterioration of the sensitivity for the reception of AM radio signals.

Figure 5:
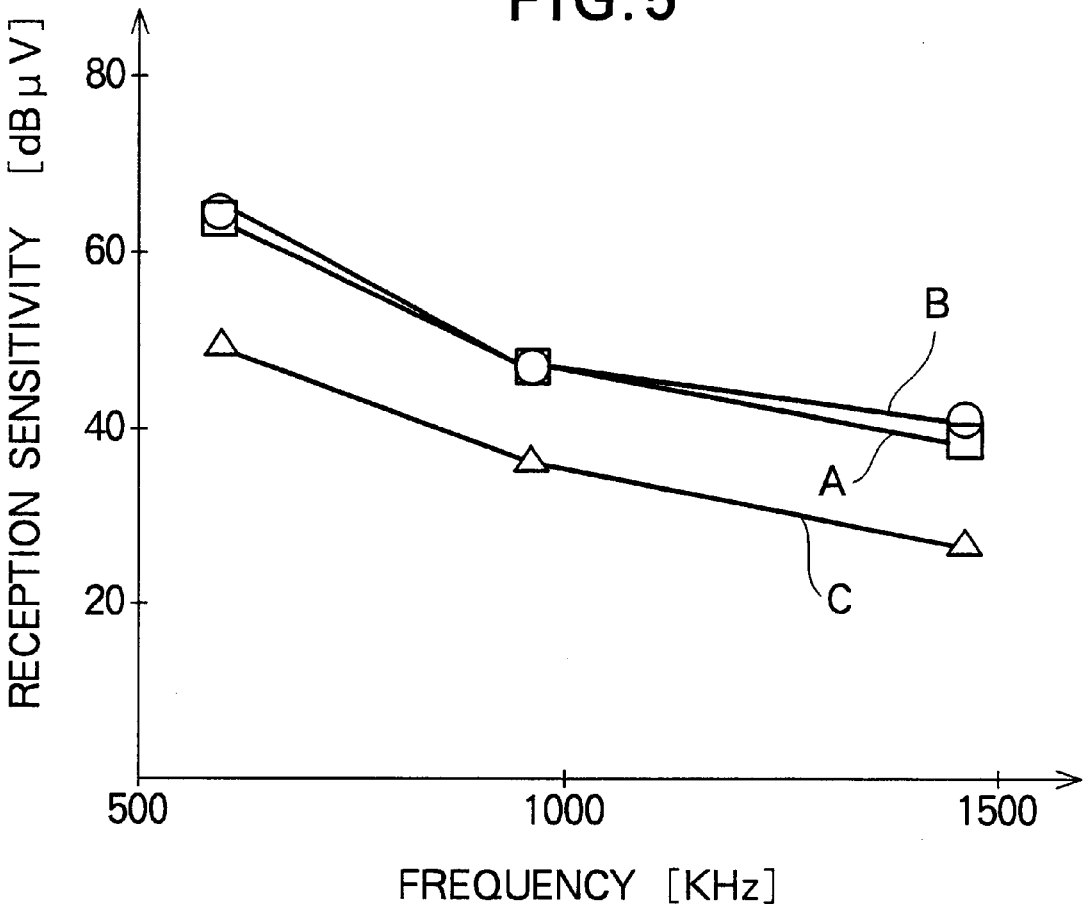
FIG. 5 is a graph illustrating frequency characteristics upon signal reception by the window glass antenna apparatus.

FIG. 5 is a graph illustrating the reception sensitivity frequency characteristics of the window glass antenna apparatus according to the present invention.

In the graph of FIG. 5, reference character A represents the reception sensitivity of a front pillar whip antenna. Reference character B represents the reception sensitivity of the window glass antenna apparatus 1 shown in FIG. 1. C represents the reception sensitivity of the inner conductor 6*c* of the signal cable 6 where the first impedance transformer 7 is deleted from the window glass antenna apparatus 1.

The window glass antenna apparatus of B is related to the case of FIG. 3 wherein the first impedance transformer 7 is set to have the inductance of 5 mH, the winding or turn ratio of the primary winding to the secondary winding is set to be 9:1, and the turn ratio of the connection point P—terminal 7*d* to the terminal 7*c*—terminal 7*d* is set to be 1:1. The level of reception sensitivity represented by B exhibits no problems for practical uses as compared to A.

In the case of C, the level of reception sensitivity in the AM frequency band dropped about −11 to −17 dB $\mu$V from A and B.

Figure 6:
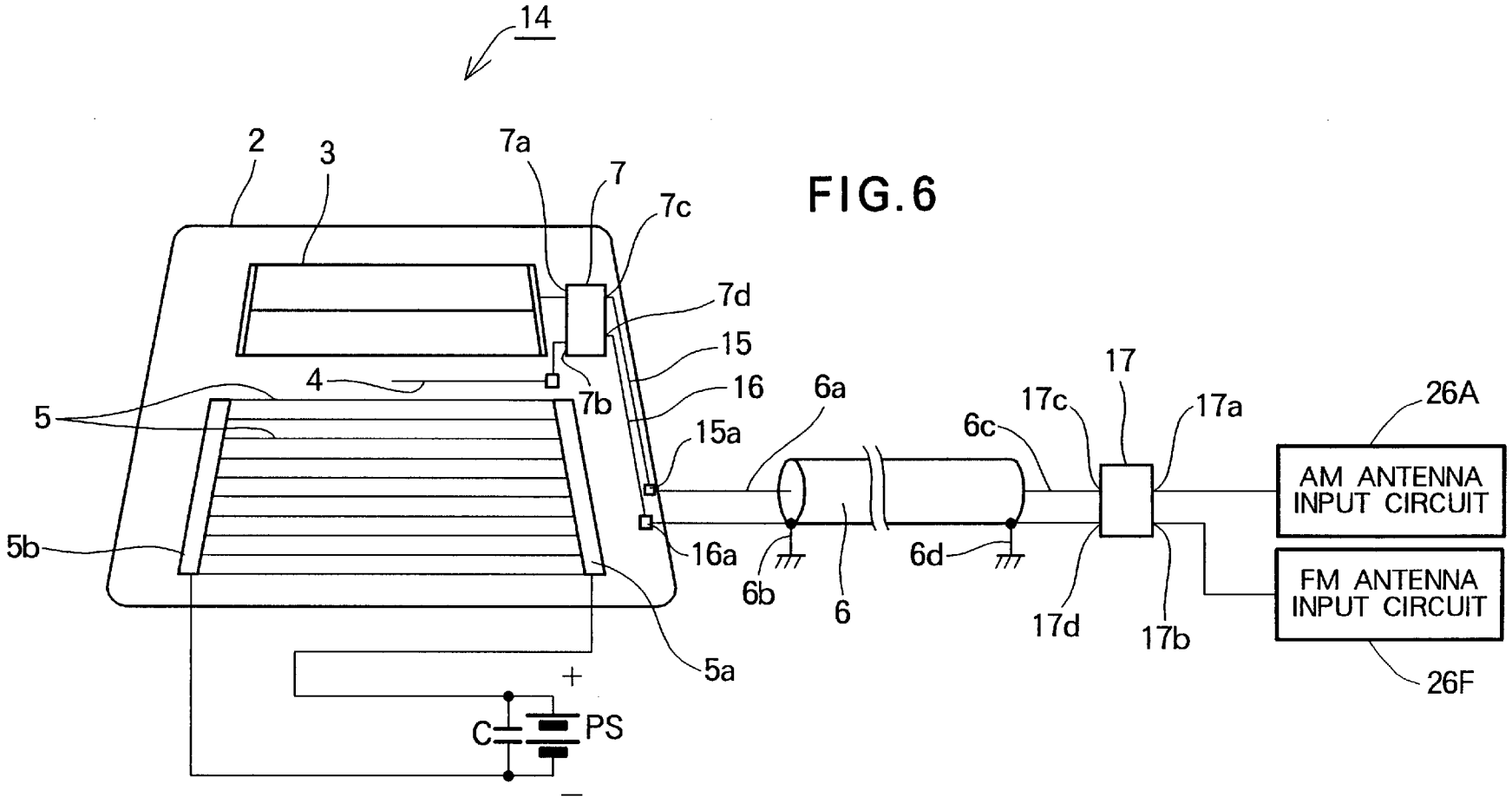
FIG. 6 is a schematic view illustrating the general arrangement of a window glass antenna apparatus according to another embodiment of the present invention.

FIG. 6 schematically illustrates a window glass antenna apparatus 14 according to a further embodiment of the present invention.

As shown in FIG. 6, the window glass antenna apparatus 14 is characterized by signal lines 15, 16 extending from the secondary side terminals 7*c*, 7*d* of the first impedance transformer 7 along a side edge of the window glass 2. The signal lines 15, 16 are provided on the window glass 2 in the form of conductive patterns. Each terminal 15*a*, 16*a* of the signal lines 15, 16 is also disposed on the window glass 2. The terminal 15*a* is connected to the inner conductor 6*a* of the signal cable 6 while the terminal 16*a* is connected to the external conductor 6*b* of the signal cable 6.

The signal lines 15, 16 are provided when the construction of the automobile or the window glass 2 does not allow connection of the signal cable 6 to an upper part of the window glass 2 and received signals need to be taken out from a lower part of the window glass 2.

The conductive patterns forming the signal lines 15, 16 desirably have a width of 3–5 mm so that transmission loss of received signals due to the signal lines 15, 16 themselves can be kept to a minimum.

The distance between the signal line 16 and the bus bar 5*a* may desirably be in the range of 3–5 mm so that an adhesive bonding the bus bar 5*a* onto the window glass 2 does not come into contact with the feeder cable 16. If there is no risk of contact between the adhesive and the feeder cable 16, the distance between the signal line 15 and the bus bar 5*a* may be about 2 mm.

Figure 7:
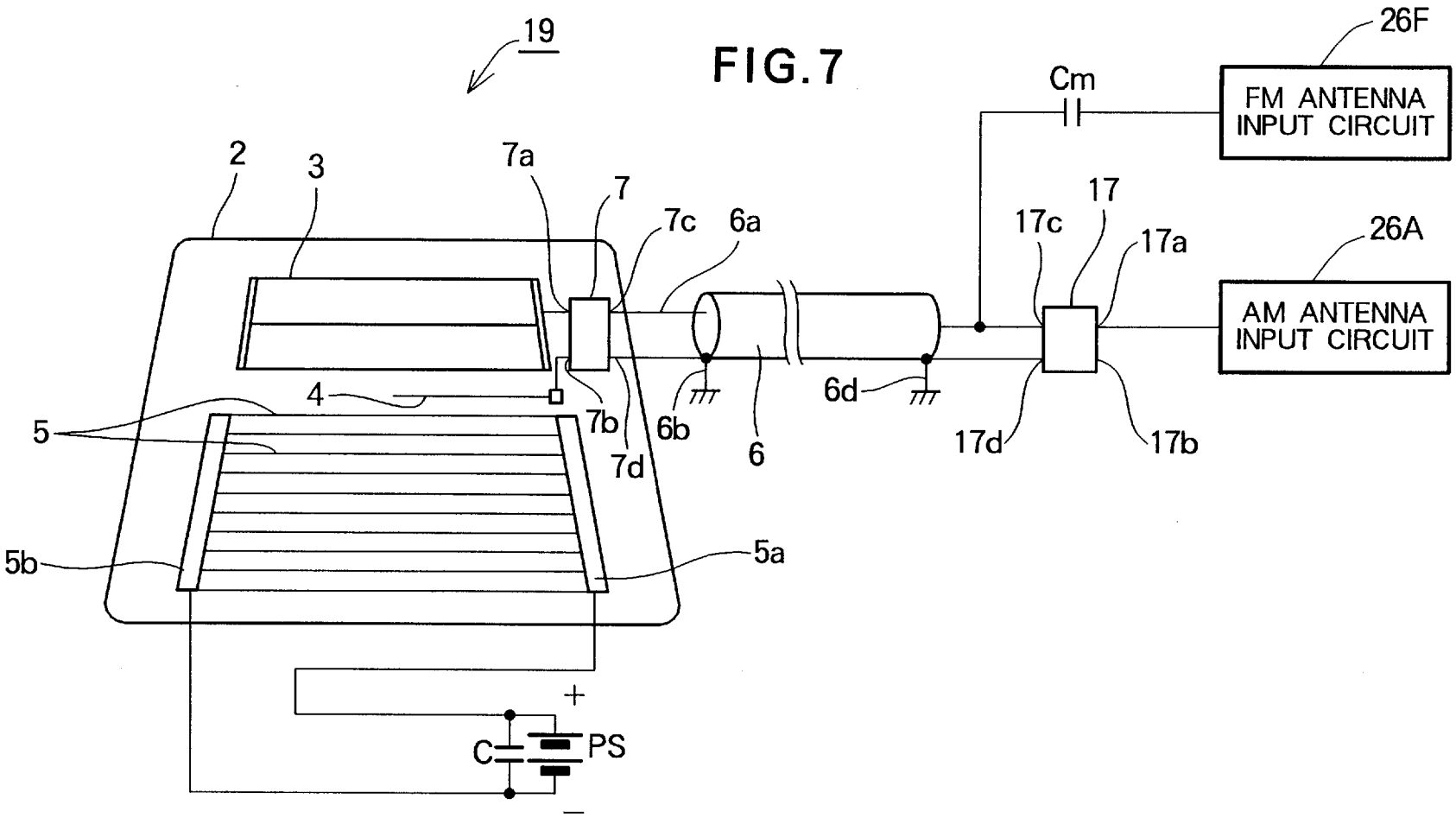
FIG. 7 is a schematic view illustrating the general arrangement of a window glass antenna apparatus according to an additional embodiment of the present invention.

Reference is now had to FIG. 7 which illustrates a window glass antenna apparatus 19 according to a still further embodiment of the present invention.

The window glass antenna apparatus 19 differs from the window glass antenna apparatus 1 shown in FIG. 1 in that it includes a capacitor Cm connected at one end thereof to the output side inner conductor 6*c* of the signal cable 6 and having an FM radio signal output terminal at an opposite end thereof connected to the FM antenna input circuit 26F. The capacitance of the capacitor Cm may be about 50 pF.

Impedance transformation in the FM frequency band may be effected by the first impedance transformer 7 for achieving the desired impedance matching. By use of the capacitor Cm, AM radio signals having frequencies lower than those of FM radio signals can be attenuated at an FM radio signal output terminal.

The capacitor Cm may also be applied to the window glass antenna apparatus 14 shown in FIG. 6.

Each of the first and second impedance transformers 7, 17 may be in the form of a flexible printed-circuit board with spiral wirings printed thereon so that they are light in weight compared to cases wherein magnets of e.g., ferrite are used. Use of the flexible printed-circuit board is also desired in that it allows formation of various other circuits thereon.

Use of the flexible printed-circuit boards is also advantageous in that when the terminals of the printed-circuit boards slip slightly out of place upon connection thereof to the wirings on the window glass, their positions can be corrected by bending the boards. It may also be appreciated that although the window glass has various delicate curves, the printed-circuit boards can be adapted to those curves easily because they are flexible.

Transparent or semitransparent flexible printed-circuit boards may also be used so that the wirings and feed terminals on the window glass can be seen therethrough, because this enables easy positioning of the terminals of the boards relative to the wirings and feed terminals, thereby increasing the productivity of the window glass antenna apparatus.

Obviously, various minor changes and modifications of the present invention are possible in the light of the above teaching. It is therefore to be understood that within the scope of the appended claims, the present invention may be practiced otherwise than as specifically described.

What is claimed is:

1. A window glass antenna apparatus having an AM radio signal receiving antenna and an FM radio signal receiving antenna, both disposed on a window glass of an automobile, and a signal cable for transmitting received signals from the antennas, said window glass antenna apparatus comprising:

a first impedance transformer including a primary winding and a secondary winding for transforming impedance in a frequency band of AM radio signal from high impedance to low impedance, said primary winding having a terminal provided at one end thereof and connected to said AM radio signal receiving antenna, and a tap provided at a primary side thereof and connected to said FM radio signal receiving antenna, said secondary winding having a terminal provided at one end thereof and connected to an input side of an inner conductor of said signal cable;

a second impedance transformer including a primary winding and a secondary winding for transforming impedance in the AM radio signal frequency band from low impedance to high impedance, said primary winding having a terminal provided at one end thereof and connected to an output side of said inner conductor of said signal cable; and said secondary winding of said second impedance transformer having one end for serving as an AM radio signal output terminal, said second impedance transformer having a tap provided at a secondary side thereof for serving as an FM radio signal output terminal.

2. A window glass antenna apparatus according to claim 1, wherein said first impedance transformer comprises spiral wirings printed on a flexible printed-circuit board.

3. A window glass antenna apparatus having an AM radio signal receiving antenna and an FM radio signal receiving antenna, both disposed on a window glass of an automobile, and a signal cable for transmitting received signals from the antennas, said window glass antenna apparatus comprising:

a first impedance transformer including a primary winding and a secondary winding for transforming impedance in a frequency band of AM radio signal from high impedance to low impedance, said primary winding having a terminal provided at one end thereof and connected to said AM radio signal receiving antenna, and a tap provided at a primary side thereof and connected to said FM radio signal receiving antenna, said secondary winding having a terminal provided at one end thereof and connected to an input side of an inner conductor of said signal cable;

a second impedance transformer including a primary winding and a secondary winding for transforming impedance in the AM radio signal frequency band from low impedance to high impedance, said primary winding having a terminal provided at one end thereof and connected to an output side of said signal cable inner conductor; and a capacitor having one end connected to said output side of said inner conductor and an opposite end for serving as an FM radio signal output terminal, said secondary winding of said second impedance transformer having one end for serving as an AM radio signal output terminal.

4. A window glass antenna apparatus according to claim 3, wherein said first impedance transformer comprises spiral windings printed on a flexible printed-circuit board.

5. A window glass antenna apparatus according to one of claims 1–4, wherein said first impedance transformer comprises a transformer, and wherein a turn ratio of a primary side to a secondary side of said transformer is within a range of 20:1–4:1.

* * * * *